United States Patent [19]

Wilbers et al.

[11] 4,250,610

[45] Feb. 17, 1981

[54] CASTING DENSIFICATION METHOD

[75] Inventors: Lawrence G. Wilbers, Cincinnati; Wilbur H. Schweikert, Fairfield, both of Ohio

[73] Assignee: General Electric Company, Cincinnati, Ohio

[21] Appl. No.: 54

[22] Filed: Jan. 2, 1979

[51] Int. Cl.[3] ..... B23P 17/00; B22D 11/126

[52] U.S. Cl. ..... 29/424; 148/131; 148/11.5 F; 148/133; 148/11.5 R; 29/526.2; 29/526.4; 29/527.2; 29/530

[58] Field of Search ..... 148/11.5 R, 11.5 F, 148/133, 131; 75/208 R, 208 CS; 29/420.5, 527.2, 423, 424, 526.2, 527.4, 527.1, 530, 527.3, 526.4, 526.6

[56] References Cited

U.S. PATENT DOCUMENTS

| | | | |
|---|---|---|---|
| 3,455,682 | 7/1969 | Barbaras | 75/226 |
| 3,469,976 | 9/1969 | Iler | 75/204 |
| 3,496,624 | 2/1970 | Kerr et al. | 29/196.2 |
| 3,758,347 | 9/1973 | Stalker | 148/4 |
| 4,104,782 | 8/1978 | Veeck et al. | 75/208 R |

*Primary Examiner*—Leon Gilden
*Assistant Examiner*—V. K. Rising
*Attorney, Agent, or Firm*—Lee H. Sachs; Derek P. Lawrence

[57] ABSTRACT

The hot isostatic pressure (HIP) method for densification of a metal casting which includes surface-connected discontinuities over which a coating is applied to bridge surface openings associated with the discontinuities and to prevent pressurizing fluid penetration within such discontinuities is improved through the application of a selected type of ceramic coating. Such coating is of a material which provides a substantially gas impervious ceramic coating, preferably of a thickness in the range of about 0.003–0.01", having a coefficient of thermal expansion matched with that of the casting surface to which it is applied as well as having the property of being viscous under the densification processing conditions at which the bond between the coating and the casting surface degrades. Upon cooling, the coating is easily removed from the surface of the densified casting.

3 Claims, No Drawings

CASTING DENSIFICATION METHOD

The invention herein described was made in the course of or under a contract, or a subcontract thereunder, with the United States Department of the Air Force.

FIELD OF THE INVENTION

This invention relates to casting densification through the application of a selected combination of temperature and isostatic pressure and, more particularly, to that form of such densification involving surface-connected casting discontinuities.

BACKGROUND OF THE INVENTION

Because of the nature of conventional metal casting methods and molds, molten metal, when solidifying after casting, can experience variability in cooling rates. This has been recognized to result in a variety of casting discontinuities including porosity, microfissures and internal tears. Many of such discontinuities are well within the casting and unconnected with the casting surface. However, some are surface-connected through surface openings.

Hot isostatic pressing (HIP) processing, a production process, subjects a casting to a preselected combination of temperature and pressure to heal discontinuities, through the creeping together and diffusion bonding of the surfaces of internal porosity, microfissures, etc., or the homogenization of undesirable internal phase regions within the casting. In order to prevent pressurizing fluid used in such HIP processing from penetrating into surface openings of surface-connected discontinuities, coatings have been applied to the casting outer surface to bridge such openings. The HIP process and the application of such coatings is described in U.S. Pat. No. 3,758,347 - Stalker, issued Sept. 11, 1973, the disclosure of which is incorporated herein by reference. In that disclosure, application of the HIP process has been described in connection with alloys based on such elements as Ni, Co, Fe and Ti, although it should be recognized that the application of such process to other materials can be and have been made. For example, such application is contemplated for the closure of sub-surface porosity in aluminum or aluminum alloy castings in U.S. Pat. No. 3,496,624 - Kerr et al, issued Feb. 24, 1970, the disclosure of which is incorporated herein by reference. Thus, the HIP process can be practiced within a relatively broad temperature range, for example about 1,300–2,200° F., depending upon the alloy being treated. The temperature is selected so that there will be substantially no degradation in the mechanical properties of the metal as a result of the HIP processing but sufficiently high in level to achieve diffusion bonding of the surfaces of the discontinuities. For example, in the range of about 1–30 thousand psi, sufficient pressure is applied to exceed the creep strength of the alloy being processed at the preselected temperature.

As is shown in the above-incorporated Stalker patent, surface-connected porosity can be healed through the use of a surface coating which prevents HIP pressurizing fluid penetration beneath the surface and into the surface-connected discontinuities. One type of coating which has been used for this purpose is a metal coating deposited over the surface-connected openings. Such a metallic coating in the form of nickel electro-plate is discussed in Example 2 of the above-incorporated Stalker patent. Further evaluation of the use of such metallic coatings has recognized that a change occurs in surface chemistry of the casting. Removal of such a changed surface can add undesirable cost to the process. Therefore, the present invention is an improvement on the invention of such incorporated Stalker patent through the provision of an improved coating useful in the above-described HIP process when applied to castings with surface-connected discontinuities.

SUMMARY OF THE INVENTION

It is a principal object of the present invention to provide, in a casting densification method, use of an improved coating for the bridging of surface openings of surface-connected discontinuities and to prevent pressurizing fluid penetration within such surface-connected discontinuities.

This and other objects and advantages will be more fully understood from the following detailed description and examples, all of which are intended to be typical of, rather than in any way limiting on the scope of the present invention.

Briefly, the method of the present invention provides an improvement to a hot isostatic pressure method for densification of a metal casting which includes surface-connected discontinuities, the surface openings of which are bridged with a coating and then the coated casting is subjected to a combination of selected processing temperature and isostatic pressure to densify the casting. The improvement comprises application of the coating in the form of a ceramic material which, after being heated to a glazing temperature, results in a non-metallic, amorphous, substantially gas impervious ceramic coating, preferably of a typical thickness in the range of 0.003–0.01'. The coefficient of thermal expansion of the coating is matched to that of the casting up to the HIP densification processing temperature sufficient to avoid crazing, cracking and spalling during densification. In addition, the ceramic coating has the property of being viscous at the temperature of such HIP processing and thus has the ability or characteristic to move and extrude into small openings, aiding and abetting the closure mechanism. Without such ability, the ceramic coating might otherwise crack under pressure and fail to seal the surface openings. Also, during HIP processing, the coatings bond with the casting surface degrades. Thus, upon cooling after processing, the coating is easily removable. The ceramic material first is heated at a glazing temperature to vitrify the material into the ceramic coating without providing a significantly strong bond with the casting surface. After glazing, the coated casting is cooled and then is subjected to HIP processing after which it is again cooled and the ceramic coating is removed.

BRIEF DESCRIPTION OF THE PREFERRED EMBODIMENTS

Current practice of the HIP process for casting densification, in one form, includes the application of a metallic coating such as electrodeposited nickel to the surface to a nickel-base superalloy casting prior to subjecting the casting to densification. Because such densification is conducted at relatively high temperatures, for example in excess of 2,000° F. for nickel-base superalloys, diffusion of such a coating into the surface portion of the casting results. Tests have indicated that such diffusion alters the casting surface chemistry and might result in a detrimental effect on certain mechanical properties of the alloy if not removed, at additional processing cost. Thus, designers are reluctant to allow such densification to occur with metallic coatings bridging surface openings of surface-connected discontinuities.

Ceramic-type coatings have been used for improved life on high temperature articles such as for turbomachinery articles, gas turbine engine combustors and exhaust components. However, such coatings have been selected and applied in a manner which is intended to result in their tight adherence to the surface to which they are applied and their ability to withstand many thermal cycles typically experienced by gas turbine engine components. In addition, such coatings are intended to be solid or non-viscous at their operating temperature so that they are not easily eroded by flowing gases.

The ceramic coating used in the method of the present invention is intended to perform a different function: it is not intended to survive a complete thermal cycle up to the HIP processing temperature and then down to ambient, but it is intended, during such HIP processing, to loosen its bond with the surface to which it is applied. In this way, such a coating is easily removable at the completion of HIP processing because it is not intended to remain on an article surface.

During the evaluation of the method of the present invention, a variety of ceramic-type coating materials were evaluated on high temperature superalloys of the group consisting of Ni, Co and Fe base alloys as well as on alloys based on Ti and alloys based on Al, the coatings functioning as surface sealants for surface-connected porosity or discontinuities in HIP densification of castings. It was recognized that true glasses have only limited usefulness in that type of HIP processing in which the castings to be densified are loaded substantially at room temperature into autoclaves for processing. Such limited usefulness is based on the thermal expansion mismatch of the glass with metal parts. However, it was found, according to the method of the present invention, that ceramic materials of the type sometimes referred to as porcelain enamels can be adjusted in composition to provide an appropriate match in thermal expansion characteristics between the resulant ceramic coating and the metal to which the coating is applied. According to the present invention, such a material is selected to be matched in coefficient of thermal expansion in the temperature range of from about room temperature up to the selected HIP processing temperature. In addition, the ceramic material has the characteristic of being substantially viscous at that temperature, to assist the closure mechanism, and has the characteristic of bond degradation or relaxation during processing, believed to be as the result of change in coating structure.

Typical of such a ceramic material which can function in such a manner is a proprietary coating of the Ferro Corporation which they have identified as JB-392-C and which was used in the evaluation of the present invention. It has been found that such a ceramic material is particularly useful with nickel-base superalloys of the type used in gas turbine engine applications. Such a material includes predominantly oxides of Si, B, and Cr along with other ingredients such as clay and is characterized by the substantial absence of compounds of Pb, found to be detrimental to turbine engine alloys. Another characteristic of this particular ceramic material is that it includes an oxide of Cr which assists bonding of the coating to the surface of such nickel-base superalloys including Cr in its composition. However, such a bond is not sufficiently strong to inhibit removal after processing.

EXAMPLE 1

The above-identified material JB-392-C was evaluated as a coating on cast specimens of nickel-base superalloys commercially available as IN718 alloy and as Rene' 77 alloy. The surface of each of the specimens which, as shown by X-rays, included sub-surface as well as surface-connected porosity within the casting, was first cleaned and slightly roughened such as by grit blasting. Because a permanent bond was not desired, the surface to be coated was not prepared in the manner ordinarily used in ceramic coating to result in a tightly inherent bond. The ceramic coating material in the form of a sodium phosphate base slip having a specific gravity of about 1.7 g/cc was sprayed in a conventional manner used in the spraying art to a wet thickness of about 0.008–0.012". As applied, the coating is only about 50% dense. After drying, for example at about 250° F., the ceramic material was subjected to a glazing temperature of about 1,750° F. to form a non-metallic, amorphous, substantially gas impervious ceramic coating of a typical thickness in the range of about 0.003–0.01" in the final coated condition. Upon cooling to room temperature from the glazing temperature, it was noted that the coefficient of thermal expansion of the coating matched that of the nickel-base superalloys to the extent that the coating was not caused to craze or spall from the coated surface. The nickel-base superalloy specimens were then subjected to HIP processing in the manner described in the above-incorporated Stalker patent, the IN718 alloy being processed at about 2,125° F. and the Rene' 77 alloy being processed at about 2,225° F., both under a pressure bond of about 15,000 psi for 2–3 hours. After cooling to room temperature, it was noted that portions of the coating had spalled from the surface of the casting as a result of the degradation of the bond between the ceramic coating and the casting surface during HIP processing. It is believed that such degradation occurred because the coating becomes viscous at that processing temperature.

X-ray evaluations of the specimens after HIP processing indicated closure of the surface-connected porosity. In further evaluation of the specimens associated with Example 1, it was recognized that the ceramic coating thickness after glazing and vitrification, and prior to HIP processing, is preferred to average about 0.003–0.01" in order to provide a continuous, substantially gas impervious coating. It was observed that, for the coatings investigated, less than about 0.003" average thickness presented problems in providing a continuous, impervious coating, whereas coating at greater than an average thickness of about 0.01" resulted in cracking and crazing of the coating. Therefore, the method of the present invention provides a ceramic coating having an average thickness in the range of about 0.003 –0.01". This is in contrast with a lower average thickness of about 0.0015–0.035" frequently recommended by the manufacturers of the type of ceramic coating material employed in the method of the present invention.

EXAMPLE 2

The method of Example 1 was repeated on specimens of a titanium-base alloy consisting essentially of, by weight, 6% Al, 4% V with the balance Ti, generally referred to as Ti-6-4 alloy. In this example, a ceramic material proprietary to the Ferro Corporation and identified by them as J087B was employed. The ceramic material, after being sprayed on the roughened Ti-6-4 alloy surface and dried at about 250° F., was heated at a glazing temperature of about 1,500° F. to vitrify the ceramic material into the ceramic coating having an average thickness of about 0.004–0.007". After cooling to room temperature from the glazing temperature, the HIP processing was conducted at about 1,650° F. under a pressure of about 15,000 psi for about 2–3 hours, with the same beneficial results as were obtained in Example 1.

During the evaluation of the present invention, it was recognized that the ceramic material, after being applied such as by dipping or spraying onto the surface of a casting to be treated and dried in preparation for glazing and vitrification, sometimes required transport or handling from the point of application of the ceramic material to the area in which the curing or glazing of the ceramic prior to HIP processing was to be conducted. In order to avoid damage to the relatively soft, preliminary coating prior to vitrification, a protective solution of a material which decomposes upon heating without leaving a substantial residue was applied to the surface. Such a material, commonly available and used in the brazing art, and which was used with the present invention was an acrylic resin solution in a thinned, sprayable condition. Therefore, one embodiment of the method of present invention includes the use of such a protective coating after application and drying of the ceramic material and prior to coating vitrification.

Although the present invention has been described in connection with specific examples and embodiments, it will be readily recognized by those skilled in the art the variations and modifications of which the present invention is capable. For example, a variety of porcelain enamel-type coatings can be selected to match the coefficient of thermal expansion of the casting surface to which they are to be applied. Although application of the present method to gas turbine engine components avoids the use of lead components in the coating because of their detrimental effect on such components, other applications of the method of the present invention can use porcelain-type enamels which do include lead compounds if they are not detrimental in the intended application. In addition, the present invention can be practiced on cast alloys other than those discussed or included in the specific examples. It is intended to include within the scope of the appended claims all such variations and modifications.

We claim:

1. In a hot isostatic pressure (HIP) method for densification of a metal casting which includes surface-connected discontinuities, wherein a coating is applied to a surface of the casting to bridge surface openings associated with the discontinuities and then the casting is subjected to a combination of a selected processing temperature and isostatic pressure to densify the casting, the improvement comprising:

applying the coating in the form of a ceramic material selected to provide, at a glazing temperature less than the selected processing temperature in the HIP densification, a non-metallic amorphous, substantially gas impervious ceramic coating having a coefficient of thermal expansion matched in the temperature range of from ambient temperature to the selected densification processing temperature with the coefficient of thermal expansion of the casting surface to which it is applied, the coating having the property of being viscous at the selected densification processing temperature and having its bond with the casting surface degrade during the HIP densification;

heating the casting surface and ceramic material at the glazing temperature to vitrify the ceramic material into the ceramic coating without providing a significantly strong bond with the casting surface;

cooling the coated casing;

subjecting the coated casting surfaces to the combination of the selected processing temperature and isostatic pressure to densify the coated portion of the casting and to degrade the bond between the ceramic coating and the casting surface;

cooling the casting; and then removing the coating from the casting surface.

2. The method of claim 1 in which:

the casting is a turbomachinery article of an alloy based on an element selected from the group consisting of Ni, Co, Fe, Ti and Al;

the average coating thickness is in the range of about 0.003–0.01"; and the ceramic material is substantially free of compounds of lead.

3. The method of claim 1 including the additional step, after application of the ceramic material to the casting surface and prior to heating the material at the glazing temperature, of applying to the ceramic material a protective coating of a material which will decompose upon heating to the glazing temperature without substantial residue.

* * * * *